US007478798B2

(12) United States Patent
Minelli

(10) Patent No.: US 7,478,798 B2
(45) Date of Patent: Jan. 20, 2009

(54) CONNECTION SYSTEM BETWEEN ELECTRICALLY WELDED PANELS AND SUPPORTING POLES PARTICULARLY FOR ENCLOSURES

(75) Inventor: Fabiano Minelli, Brescia (IT)

(73) Assignee: Recintecnica Di Ferrari Bruna, Collebeato Brescia (IT)

( * ) Notice: Subject to any disclaimer, the term of this patent is extended or adjusted under 35 U.S.C. 154(b) by 0 days.

(21) Appl. No.: 10/532,701

(22) PCT Filed: Oct. 24, 2003

(86) PCT No.: PCT/IT03/00659

§ 371 (c)(1),
(2), (4) Date: Oct. 5, 2005

(87) PCT Pub. No.: WO2004/038136

PCT Pub. Date: May 6, 2004

(65) Prior Publication Data

US 2006/0118770 A1 Jun. 8, 2006

(30) Foreign Application Priority Data

Oct. 28, 2002 (IT) ..... BS020116 U

(51) Int. Cl.
*E04H 17/16* (2006.01)
*F16B 35/04* (2006.01)
*E04G 7/00* (2006.01)

(52) U.S. Cl. ..... 256/24; 256/47; 256/54; 256/55; 411/419; 403/396

(58) Field of Classification Search ..... 403/371, 403/396; 411/417–419; 439/778–780; 256/24, 256/47, 54, 55

See application file for complete search history.

(56) References Cited

U.S. PATENT DOCUMENTS

| | | | | | |
|---|---|---|---|---|---|
| 822,492 | A | * | 6/1906 | Turner | 439/778 |
| 834,669 | A | * | 10/1906 | Fricke | 439/780 |
| 1,677,783 | A | * | 7/1928 | Kearney | 439/778 |
| 1,948,838 | A | * | 2/1934 | Bash | 439/778 |
| 2,135,623 | A | * | 11/1938 | Peirce, Jr. | 403/396 |
| 4,098,493 | A | | 7/1978 | Logan | |

FOREIGN PATENT DOCUMENTS

| | | |
|---|---|---|
| DE | 35 21 453 A | 1/1986 |
| GB | 2 250 757 A | 6/1992 |
| WO | WO 01/83916 A1 | 11/2001 |

* cited by examiner

*Primary Examiner*—Victor MacArthur
(74) *Attorney, Agent, or Firm*—Hoffmann & Baron, LLP

(57) ABSTRACT

The present finding relates to a system for fixing panels consisting of are welded bars to support poles, particularly but not exclusively for fencings, wherein into said poles there is obtained at least one thorough hole (20) comprising a screw (15) having a threaded stem (16) crossed centrally and for its entire length by a longitudinal thorough slit (19), and a nut (18) intended to screw on said threaded stem, said slit being intended to receive the bars of two adjacent panels.

3 Claims, 2 Drawing Sheets

CONNECTION SYSTEM BETWEEN ELECTRICALLY WELDED PANELS AND SUPPORTING POLES PARTICULARLY FOR ENCLOSURES

This application is the U.S. National Phase of International Application Number PCT/IT2003/000659 filed on 24 Oct. 2003, which is incorporated herein by reference.

BACKGROUND OF THE INVENTION

The present finding relates to the sector of fencings or enclosures or other structures using panels consisting of arc welded bars in general, and in particular it refers to a system for fixing said panels to support poles.

At present, the fixing of the panels to the support poles is made by constraining the end bar to a side of the pole, which usually exhibits a T, H, cross or tubular-shaped section, by plaques, locking joints or similar supports, screwed by bolts or applied in another way to the pole. The fixing system is usually exposed to view and therefore for aesthetic reasons, it is hidden by covering elements. The number of elements used and the time required for installing the fencing or similar structure are therefore considerable and significantly affect the overall system cost.

SUMMARY OF THE INVENTION

Object of the present finding is that of proposing a system for fixing panels consisting of arc welded bars to support poles of a simpler structure, consisting of a reduced number of elements, and which therefore allows a quicker and easier installation of the structure made up of said panels.

Another object of the finding is that of providing a system for fixing arc welded panels to support poles which should allow realising fencings or similar structures wherein adjacent panels can form an angle with one another or can be fixed at different heights, for example step walls.

These and other objects and advantages of the finding are achieved by a system for fixing panels made up of arc welded bars to support poles conforming with claim 1.

BRIEF DESCRIPTION OF THE DRAWINGS

An example of embodiment of the finding will be described in more detail hereinafter with reference to the attached indicative and non-limiting drawings, wherein.

DETAILED DESCRIPTION OF THE INVENTION

Figure 1:
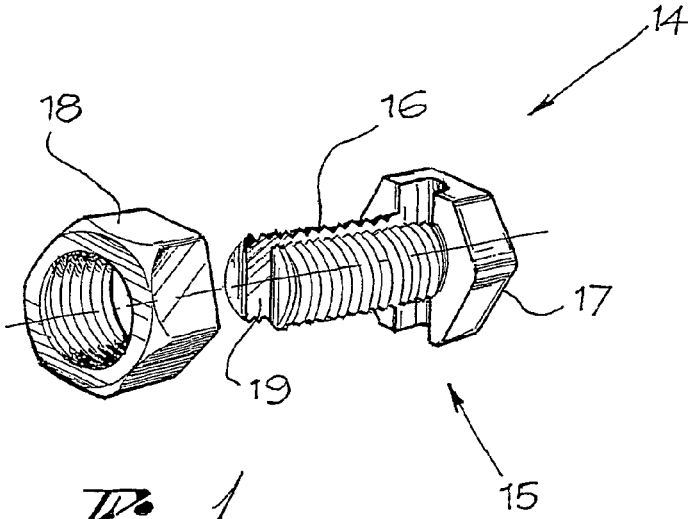
FIG. 1 shows a prospective exploded view of the fixing system under discussion.

In said drawings, reference numeral 10 indicates panels consisting of arc welded bars 10'. The panels are adapted for being fixed to support poles 11 that generally exhibit a T, H, cross, square or similar section, that is, they consist of at least one front plate element 12 and of at least one transversal plate element 13.

The system proposed for fixing panels 10 to poles 11 is shaped as a bolt 14 consisting of a screw 15 with threaded stem 16 and polygonal head 17, and of a relevant nut 18. According to the finding, stem 16 of the screw is crossed centrally and for its entire length by a longitudinal thorough slit 19 having width at least equal to the diameter or the side size of bars 10' of panels 10. The slit can partly affect also the head 17 of the screw.

The transversal plate element 13 of poles 11 is crossed by at least one hole 20 wherein the screw 15 is intended to be introduced.

The fixing of the panels to the poles therefore occurs by introducing the end bar 10' of a panel 10 into slit 19 of the screw, making the latter pass through the relevant hole 20 into the pole, introducing the end bar 10' of another optional panel adjacent pole 11 into slit 19 and tightening the whole by nut 18. With a single bolt 14 it is therefore possible to fix two panels 10 to a common pole 11. The fixing, moreover, occurs on the transversal element 13 of the pole, therefore behind the front element 12, without needing additional covering elements to hide the connection from view. In case of rectangular-section poles, the two opposed transversal sides should have aligned holes, and stem 16 of screw 15 should of course exhibit such length as to cross the pole by its entire length.

Figure 4:
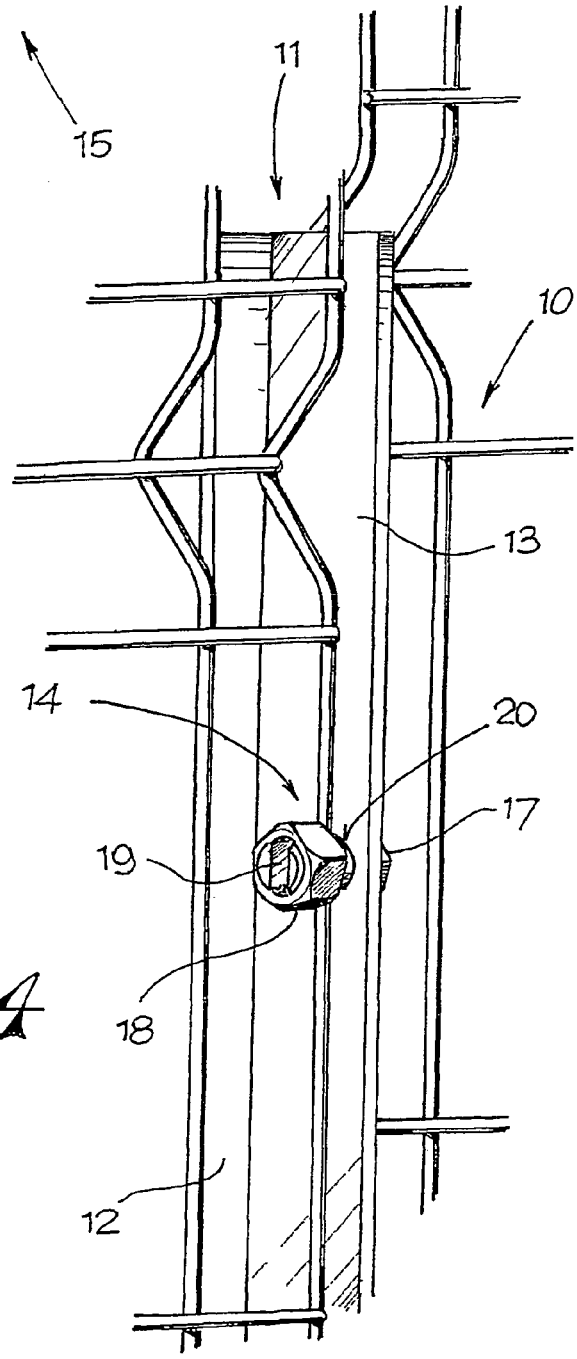
FIGS. 3 and 4 show to example of application of the fixing system similar to that of the previous Figure, where the panels fixed to the pole form an angle with one another and are at different heights, respectively.
Figure 2:
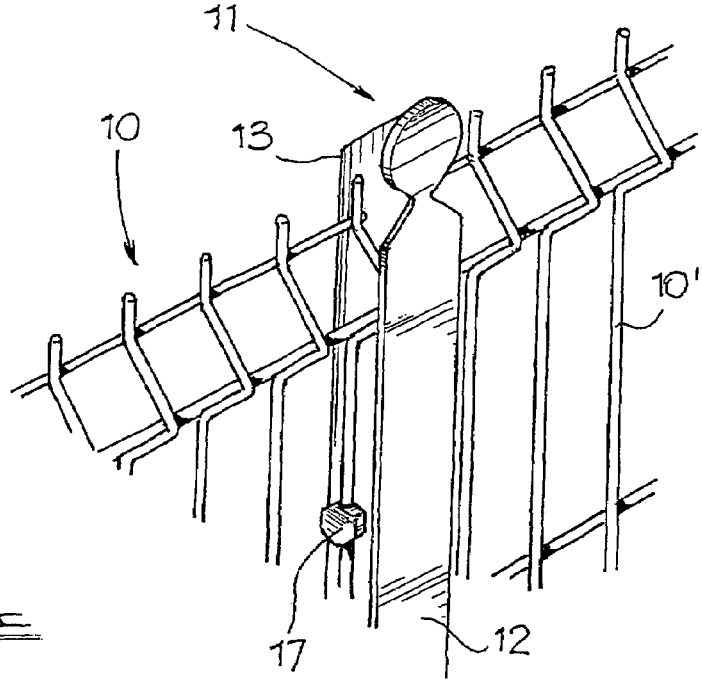
FIG. 2 shows a first example of use of the system for fixing arc welded panels to a support pole.
Figure 3:
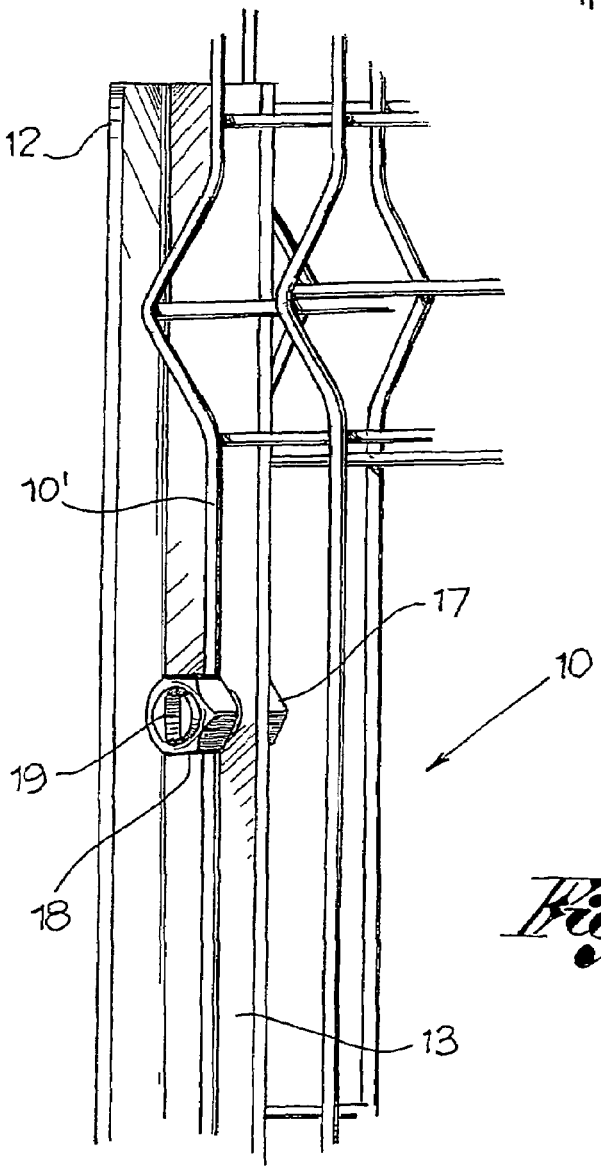

The system proposed allows bars 10' passing into slit 19 of the bolt, and therefore the relevant panels, to take any angular or height position before the final tightening by the nut, as shown in FIGS. 3 and 4. In this way, the fencings made up of panels 10 can exhibit angles and be applied to step walls. By sizing bolt 14 and slit 19 so as to receive two superimposed panels, it is also possible to connect double fencings so as to support loads according to the ministerial standards.

Moreover, in case of cross poles, and thanks to the possibility of turning the bolt in any position, it is also possible to realised structures closed on top, such as for example cages for dogs, gazebo and the like.

It should be noted that in place of a normal bolt it is possible to use a bolt with anti-tear head and nut without departing from the scope of the finding.

Finally, it has been proven that with a bolt of the type described herein, two panels can be permanently connected to one another without the need of fixing them to a common pole.

The invention claimed is:

1. A fence comprising:

at least one fence post having a T-shaped cross section formed by a front plate and a transverse plate extending perpendicularly from a centerline of the front plate, the transverse plate having at least one through hole;

a connecting bolt having a head, a threaded shaft, and a longitudinal through slit forming a hollow that completely bifurcates the shaft and partially extends into the head;

a first fence panel of welded bars having a first end bar;

a second fence panel of welded bars having a second end bar; and wherein the shaft extends through the through hole, the hollow receives the first and second end bars therethrough, and a nut is fastened to the threaded shaft to clamp the end bars to opposite sides of the transverse plate between the head and nut.

2. A fence as defined in claim 1, wherein the first and second end bars of said first and second end panels are free to angularly move in said hollow prior to clamping the end bars, whereby said first and second fence panels can be fixed at an angle with respect to each other.

3. A fence as defined in claim 1, wherein the first and second end bars of said first and second end panels are free to axially move in said hollow prior to clamping the end bars, whereby said first and second fence panels can be fixed at different heights with respect to each other.

* * * * *

UNITED STATES PATENT AND TRADEMARK OFFICE

CERTIFICATE OF CORRECTION

PATENT NO. : 7,478,798 B2
APPLICATION NO. : 10/532,701
DATED : January 20, 2009
INVENTOR(S) : Fabiano Minelli It is certified that error appears in the above-identified patent and that said Letters Patent is hereby corrected as shown below:

TITLE PAGE:

Item (57) ABSTRACT: now reads "panels consisting of are welded bars"
should read -- panels consisting of arc welded bars --

Signed and Sealed this

Fourth Day of August, 2009

John Doll

JOHN DOLL
*Acting Director of the United States Patent and Trademark Office*